US005080115A

United States Patent [19]

Templeton

[11] Patent Number: 5,080,115

[45] Date of Patent: Jan. 14, 1992

[54] SIMULATED SMOKING ARTICLE

[75] Inventor: Leroi K. Templeton, Louisville, Ky.

[73] Assignee: Brown & Williamson Tobacco Corporation, Louisville, Ky.

[21] Appl. No.: 554,647

[22] Filed: Jul. 19, 1990

[51] Int. Cl.[5] ..... A24F 47/00

[52] U.S. Cl. ..... 131/273; 131/194; 131/336; 131/359

[58] Field of Search ..... 131/194, 273, 274, 335, 131/336, 337, 338, 359, 364, 365

[56] References Cited

U.S. PATENT DOCUMENTS

| | | | |
|---|---|---|---|
| 3,258,015 | 2/1964 | Ellis et al. | 131/273 |
| 4,655,227 | 4/1987 | Sensabaugh, Jr. et al. | 131/335 |
| 4,714,082 | 12/1987 | Banerjee et al. | 131/335 |
| 4,732,168 | 3/1988 | Resce et al. | 131/335 |
| 4,765,347 | 8/1988 | Sensabaugh, Jr. et al. | 131/273 |
| 4,793,365 | 12/1988 | Sensabaugh, Jr. et al. | 131/361 |
| 4,819,665 | 4/1989 | Roberts et al. | 131/336 |

*Primary Examiner*—Vincent Millin
*Assistant Examiner*—Lynne A. Reichard
*Attorney, Agent, or Firm*—Charles G. Lamb

[57] ABSTRACT

A simulated smoking article comprising a non-combustible hollow cylindrical body, a filter rod coaxially located at one end of the hollow cylindrical body and a combustible fuel element at the other end of the hollow cylindrical body. A hollow thermal conducting member is located between the fuel element and adjacent end of the cylindrical body. A porous substrate cylinder, which is impregnated with an aerosol generating material, is located within the cylindrical rod between the fuel element and the filter rod. A flow accelerating means is located next to the porous substrate cylinder facing the filter rod. Upstream of the porous substrate cylinder is as gas inlet chamber and downstream toward the filter rod is a gas/aerosol mixing chamber. A conventional cigarette wrapping paper circumscribes the smoking article.

32 Claims, 1 Drawing Sheet

SIMULATED SMOKING ARTICLE

BACKGROUND OF THE INVENTION

The present invention relates to a smoking article, preferably simulated smoking device in the form of a cigarette, which produces a flavored aerosol.

Various smoking articles which generate aerosols are known. For example, U.S. Pat. No. 4,655,229 teaches an aspiration device having a paper tube with a filter at the inlet end and a plug of flavoring material inside the tube downstream of the filter, the plug being located in the tube downstream of the plug of flavoring material and an outlet filter is located at the outlet end of the tube.

U.S. Pat. No. 4,657,032 teaches an aspiration device for delivering a controlled flow of fluid to the smoker's mouth. The device includes a tobacco column with a filter at one end with a container filled with a drug disposed within the filter. The container includes an air inlet port open to the ambient at the side wall of the filter and an outlet port at the mouth end of the filter.

U.S. Pat. No. 4,714,082 teaches a smoking article including a tube having a fuel element at one end with a hole through the fuel element, a substrate impregnated with an aerosol generating substance immediately downstream of the substrate, a tobacco plug immediately downstream of the substrate, a cylinder of filter material with a concentric tube located downstream of the tobacco plug, and a filter rod at the end of the tube from the fuel element.

U.S. Pat. No. 4,732,168 teaches a smoking article which has a fuel element with passages therethrough and a jacket of tobacco located immediately downstream of the fuel element. A container containing a substrate including an aerosol generating substance is embedded in the jacket of tobacco. A cellulose acetate cylinder including an aerosol passage is located immediately downstream of the jacket of tobacco, and a filter rod is located at the end of the cylinder.

U.S. Pat. No. 4,765,347 teaches a smoking device including a container for a flavorant liquid with a tube located inside a cylindrical outer container resembling a cigarette. A tube extends from the container to the mouth end of the outer container. When a person draws on the mouth end of the outer container liquid flavorant passes from the container through the tube to the person's mouth.

SUMMARY OF THE INVENTION

The present invention provides a simulated smoking article having a non-combustible hollow cylindrical body having a filter rod at one end, a fuel element at the other end, and a porous substrate cylinder impregnated with an aerosol/flavorant generating material located in the cylindrical rod between the fuel element and filter rod.

More particularly, the present invention provides a simulated smoking article comprising a hollow cylindrical body of non-combustible material; a filter rod coaxially located at one end of the hollow cylindrical rod; a cylindrical fuel element having a central bore opening therethrough coaxially located at the other end of the hollow cylindrical body; a thermal conducting member located adjacent the cylindrical fuel element having a hollow cylindrical inlet section substantially the same circumference as the bore opening through the fuel element and a hollow cylindrical outlet section of substantially the same circumference as the hollow cylindrical body, the hollow outlet section being coaxially located with the hollow cylindrical body at the other end of the cylindrical body from the filter rod, and the hollow inlet section being received in the bore opening through the cylindrical fuel element; a porous substrate cylinder impregnated with an aerosol generating material disposed in the hollow cylindrical body between the thermal conducting member and the filter rod; and, a flow accelerating means located at the one end of the cylindrically shaped pourous substrate facing the filter rod.

BRIEF DESCRIPTION OF THE DRAWINGS

A better understanding of the present invention will be had upon reference to the following description in conjunction with the accompanying drawings wherein.

DETAILED DESCRIPTION OF THE PREFERRED EMBODIMENT

Figure 1:
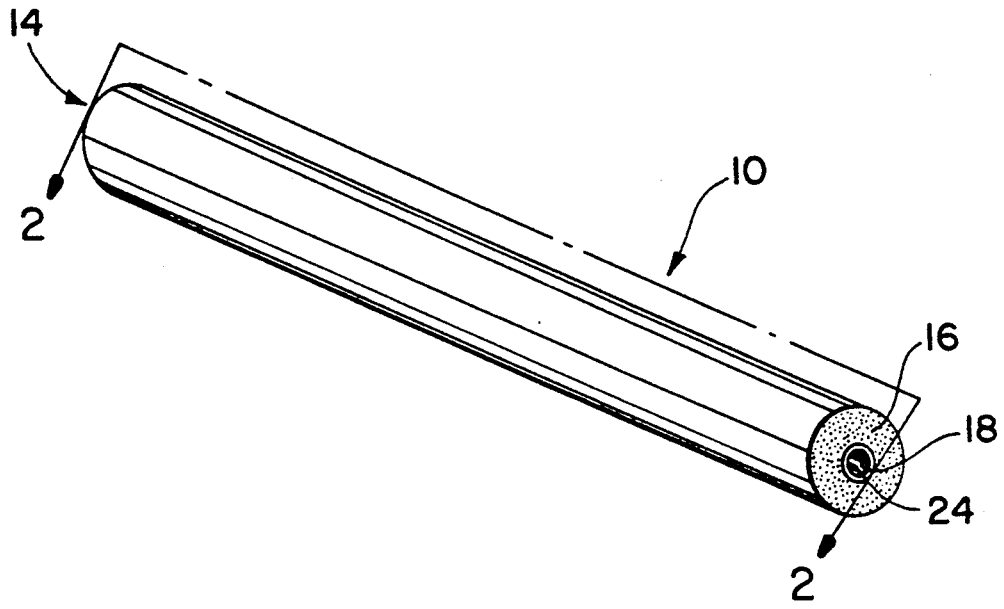
FIG. 1 is a perspective view of the smoking device of the present invention.
Figure 2:
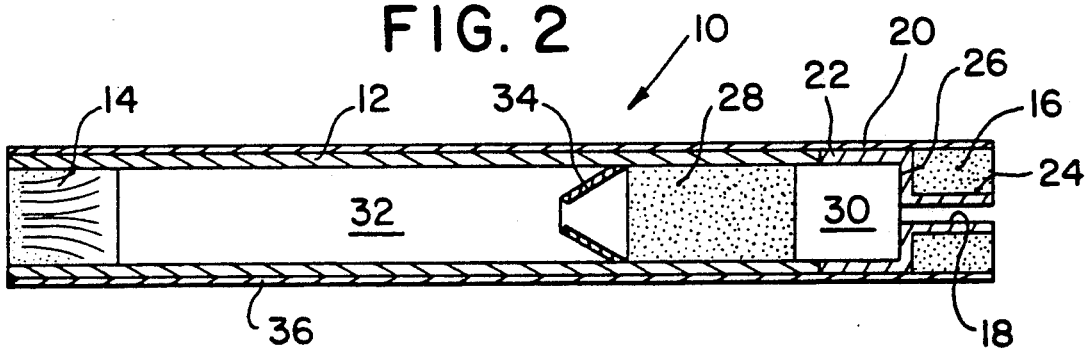
FIG. 2 is a longitudinal cross-sectional view of the smoking device as seen in the direction of arrows 2—2 in FIG. 1 including one preferred thermal conducting member of the present invention; and, FIG. 3 is another preferred embodiment of a thermal conducting member of the present invention as shown in a longitudinal cross-section exploded.

With reference to FIGS. 1 and 2, there is shown a smoking article, generally denoted as the numeral 10.

The smoking article 10 includes a hollow cylindrical body 12 fabricated of a non-combustible material such as, for example a ceramic or burn retardant treated paper. A filter rod 14 is coaxially located at one end of the hollow cylindrical body 12, and a fuel element 16 is coaxially located to the other end of the hollow cylindrical body 12. The filter rod 14 can be a conventional filter used with conventional cigarettes fabricated of, for example, cellulose acetate.

The fuel element 16 is cylindrical having a circumferential dimension substantially the same as the circumferential dimension of the hollow cylindrical body 12. Fuel element 16 is provided with a central bore 18 therethrough. The fuel element 16 can be fabricated of various materials such as carbon, charcoal particles, and combustible metals, such as, for example magnesium and aluminum.

The smoking article 10 also includes a thermal conducting member 20 which is located adjacent the cylindrical fuel element 16. The thermal conducting member 20 includes a hollow cylindrical inlet section 24 and a cylindrical outlet section 2 integral with the inlet section 24. The hollow outlet section 22 has substantially the same circumferential dimension as the circumferential dimension of the cylindrical body 12, and the hollow inlet section 24 has substantially the same circumferential dimension as the circumferential dimension of the bore opening 18 through the fuel element 16.

The outlet section 22 and inlet section 24 are axially aligned. The thermal conducting member 20, which can be fabricated of various heat conducting material such as aluminum, copper, and graphite, further includes a transverse circular disc section 26 interconnecting the outlet section 22 and the inlet section 24. The thermal conducting member 20 is axially aligned and disposed between the cylindrical body 12 and the fuel element 16. The outlet section 22 is unitary with the inlet cylindrical section 24 and the transverse circular disc section 26. The fuel element 16 circumscribes the bore opening 18 and is in abutment with the transverse circular disc section 26.

A porous substrate cylinder 28 having a circumferential dimension substantially equal to the inside circumferential dimension of the cylindrical body 12 is concentrically located in the cylindrical body 12 between the fuel element 16 and the filter rod 14.

The porous substrate cylinder 28 cooperates with the wall of the cylindrical body 12 and the thermal conducting member 20 to define a gas inlet chamber 30 in the hollow outlet section 22 upstream of the porous substrate cylinder 28, and cooperates with the wall of the cylindrical body 12 and the filter rod 14 to define a gas/aerosol mixing chamber 32 downstream of porous substrate cylinder 28. The porous substrate material of the cylinder 28 can be, for example, alumina, charcoal, silica, ceramic beads, perlite, vermiculite, and the like.

The porous substrate cylinder 28 is impregnated with an aerosol generating material such as, for example, propylene glycol, glycerin, methyl palmitate, triacetin, and the like. In another preferred embodiment, the porous substrate cylinder 28 can also be impregnated with a flavor releasing material such as, for example, tobacco, tobacco powder, tobacco extract, menthol, and the like.

A flow accelerating means 34 is located at the downstream end of the porous substrate cylinder 28. The flow accelerating means 34 is shown as a diverging truncated hollow cone having a base circumferential dimension substantially equal to the circumferential dimension of the porous substrate cylinder 28 with the base of the conical nozzle being immediately adjacent the downstream end of the porous substrate cylinder 28. The conical nozzle 34 can be fabricated of virtually any convenient material, such as a plastic or a metal.

A conventional cigarette wrapping paper 36 is shown as circumscribing the cylindrical body 12 to give the smoking article 10 the outward appearance of a conventional cigarette.

In use of the smoking article 10, the smoker ignites the fuel element 16 and draws on the mouth end of the article 10 to cause ambient air to flow through the inlet section 24 of the thermal conducting member 20 and into the gas inlet chamber 30. The heat of the ignited fuel element 16 heats the hollow inlet cylindrical section 24, the hollow outlet section 22, and the transverse circular disc section 26 of the thermal conducting member 20. The heated inlet section 24 heats the air passing therethrough into the gas inlet chamber 30, and the heated outlet section 22 heats the air within the gas inlet chamber. And, the inlet section 24 and the transverse circular disc section 26 of the thermal conducting member 20 prevent the flow of combustion gases generated by the ignited fuel element 16 from entering the gas inlet chamber 30. The heated air passes from the inlet chamber 30 and through the porous substrate cylinder 28, volatilizing the flavor generating material and aerosol generating material impregnating the porous substrate cylinder 28. The air, and volatilized flavorant and aerosol pass from the porous substrate cylinder 28 and through the flow accelerating means 34. The flow accelerating means 34 concentrates the air stream, and accelerates it toward the filter rod 14 as it passes into the gas/aerosol mixing chamber 32. As the air/flavorant/aerosol mixture passes into the gas/aerosol mixing chamber 32 it decelerates and expands filling the gas/aerosol mixing chamber 32 resulting in a homogeneous mixture of the air, flavorant, and aerosol before passing out of the gas/aerosol mixing chamber 32 through the filter rod 14 into the smoker's mouth.

Figure 3:
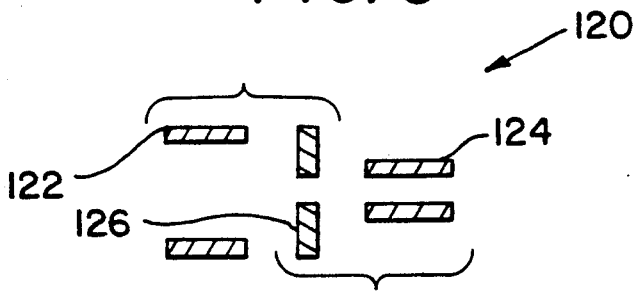

With reference to FIG. 3, there is shown another preferred embodiment of a thermal conducting member of non-unitary construction. Thermal conducting member 120 comprises a hollow inlet cylinder 124, a hollow outlet cylinder 122, and a transverse circular disc 126. These components have substantially the same dimensions as previously described for the sections of the thermal conducting member 20 of unitary construction.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A smoking article comprising:

(a) a combustible fuel element having a longitudinally extending opening of substantially uniform cross-section therethrough;

(b) a hollow circular thermal conducting member having an inlet section and an outlet section, said inlet section extending through said longitudinally extending opening of said combustible fuel element, said outlet section being larger in diameter than said inlet section;

(c) a gas inlet chamber having an inlet and an outlet, said inlet in flow communication with the inlet section of said hollow circular thermal conducting member, said outlet being substantially co-extensive with said outlet of said thermal conducting member;

(d) a porous substrate cylinder impregnated with an aerosol generating material, said porous substrate having an upstream end and a downstream end, said upstream end of said porous substrate cylinder being adjacent to and in flow communication with the outlet of said gas inlet chamber;

(e) a flow accelerating means having an opening therethrough, said flow accelerating means being adjacent to said downstream end of said porous substrate cylinder;

(f) a gas/aerosol mixing chamber having an inlet and an outlet, said chamber inlet being adjacent to and in flow communication with said opening of said flow accelerating means;

(g) a filter rod adjacent to said outlet of said gas/aerosol mixing chamber;

(h) a combustible wrapper circumscribing the entire smoking article.

2. The smoking article of claim 1, wherein a flavor releasing material is added to said porous substrate cylinder.

3. The smoking article of claim 1, wherein said hollow thermal conducting member is of unitary construction.

4. The smoking article of claim 2, wherein the hollow thermal conducting member is of unitary construction.

5. The smoking article of claim 1, wherein said inlet section of said hollow thermal conducting member is a first cylinder and said outlet section of said hollow thermal conducting member is a second cylinder, said inlet and outlet sections being connected by a transverse circular disc having an opening therethrough, said first cylinder having an inner diameter of substantially the same diameter as the opening in said disc, said second cylinder having an outer diameter substantially equal to the diameter of said disc.

6. The smoking article of claim 5, wherein said inlet section, outlet section, and disc are constructed of heat conducting materials.

7. The smoking article of claim 2, wherein said inlet section of said hollow thermal conducting member is a first cylinder and said outlet section of said hollow thermal conducting member is a second cylinder, said inlet and outlet sections being connected by a transverse circular disc having an opening therethrough, said first cylinder having an inner diameter of substantially the same diameter as the opening in said disc, said second cylinder having an outer diameter substantially equal to the diameter of said disc.

8. The smoking article of claim 7, wherein said inlet section, outlet section, and disc are constructed of heat conducting materials.

9. The smoking article of claim 1 wherein the flow accelerating means is a hollow conical shaped nozzle, said nozzle being open at its vertex, said nozzle having a base adjacent to and of substantially the same diameter as said porous substrate cylinder, said vertex being directed toward said filter rod.

10. The smoking article of claim 2 wherein the flow accelerating means is a hollow conical shaped nozzle, said nozzle being open at its vertex, said nozzle having a base adjacent to and of substantially the same diameter as said porous substrate cylinder, said vertex being directed toward said filter rod.

11. The smoking article of claim 3 wherein the flow accelerating means is a hollow conical shaped nozzle, said nozzle being open at its vertex, said nozzle having a base adjacent to and of substantially the same diameter as said porous substrate cylinder, said vertex being directed toward said filter rod.

12. The smoking article of claim 4 wherein the flow accelerating means is a hollow conical shaped nozzle, said nozzle being open at its vertex, said nozzle having a base adjacent to and of substantially the same diameter as said porous substrate cylinder, said vertex being directed toward said filter rod.

13. The smoking article of claim 5 wherein the flow accelerating means is a hollow conical shaped nozzle, said nozzle being open at its vertex, said nozzle having a base adjacent to and of substantially the same diameter as said porous substrate cylinder, said vertex being directed toward said filter rod.

14. The smoking article of claim 6 wherein the flow accelerating means is a hollow conical shaped nozzle, said nozzle being open at its vertex, said nozzle having a base adjacent to and of substantially the same diameter as said porous substrate cylinder, said vertex being directed toward said filter rod.

15. The smoking article of claim 7 wherein the flow accelerating means is a hollow conical shaped nozzle, said nozzle being open at its vertex, said nozzle having a base adjacent to and of substantially the same diameter as said porous substrate cylinder, said vertex being directed toward said filter rod.

16. The smoking article of claim 8 wherein the flow accelerating means is a hollow conical shaped nozzle, said nozzle being open at its vertex, said nozzle having a base adjacent to and of substantially the same diameter as said porous substrate cylinder, said vertex being directed toward said filter rod.

17. The smoking article of claim 1 wherein the noncombustible hollow cylindrical body adjoining said thermal conducting member also circumscribes a small portion of the gas inlet chamber.

18. The smoking article of claim 2 wherein the noncombustible hollow cylindrical body adjoining said thermal conducting member also circumscribes a small portion of the gas inlet chamber.

19. The smoking article of claim 3 wherein the noncombustible hollow cylindrical body adjoining said thermal conducting member also circumscribes a small portion of the gas inlet chamber.

20. The smoking article of claim 4 wherein the noncombustible hollow cylindrical body adjoining said thermal conducting member also circumscribes a small portion of the gas inlet chamber.

21. The smoking article of claim 5 wherein the noncombustible hollow cylindrical body adjoining said thermal conducting member also circumscribes a small portion of the gas inlet chamber.

22. The smoking article of claim 6 wherein the noncombustible hollow cylindrical body adjoining said thermal conducting member also circumscribes a small portion of the gas inlet chamber.

23. The smoking article of claim 7 wherein the noncombustible hollow cylindrical body adjoining said thermal conducting member also circumscribes a small portion of the gas inlet chamber.

24. The smoking article of claim 8 wherein the noncombustible hollow cylindrical body adjoining said thermal conducting member also circumscribes a small portion of the gas inlet chamber.

25. The smoking article of claim 9 wherein the noncombustible hollow cylindrical body adjoining said thermal conducting member also circumscribes a small portion of the gas inlet chamber.

26. The smoking article of claim 10 wherein the noncombustible hollow cylindrical body adjoining said thermal conducting member also circumscribes a small portion of the gas inlet chamber.

27. The smoking article of claim 11 wherein the noncombustible hollow cylindrical body adjoining said thermal conducting member also circumscribes a small portion of the gas inlet chamber.

28. The smoking article of claim 12 wherein the noncombustible hollow cylindrical body adjoining said thermal conducting member also circumscribes a small portion of the gas inlet chamber.

29. The smoking article of claim 13 wherein the noncombustible hollow cylindrical body adjoining said thermal conducting member also circumscribes a small portion of the gas inlet chamber.

30. The smoking article of claim 14 wherein the noncombustible hollow cylindrical body adjoining said thermal conducting member also circumscribes a small portion of the gas inlet chamber.

31. The smoking article of claim 15 wherein the noncombustible hollow cylindrical body adjoining said thermal conducting member also circumscribes a small portion of the gas inlet chamber.

32. The smoking article of claim 16 wherein the noncombustible hollow cylindrical body adjoining said thermal conducting member also circumscribes a small portion of the gas inlet chamber.

* * * * *